US010012068B2

(12) United States Patent
O'Reilly

(10) Patent No.: US 10,012,068 B2
(45) Date of Patent: Jul. 3, 2018

(54) ALIGNMENT SYSTEM FOR ALIGNMENT OF A DRILL ROD DURING DRILLING

(71) Applicant: PRECISION ALIGNMENT HOLDINGS PTY LTD, Malaga, Western Australia (AU)

(72) Inventor: Jordan O'Reilly, Yeppoon (AU)

(73) Assignee: PRECISION ALIGNMENT HOLDINGS PTY LTD, Malaga, Western Australia (AU)

( * ) Notice: Subject to any disclaimer, the term of this patent is extended or adjusted under 35 U.S.C. 154(b) by 81 days.

(21) Appl. No.: 14/902,753

(22) PCT Filed: Jul. 4, 2014

(86) PCT No.: PCT/AU2014/000697
§ 371 (c)(1),
(2) Date: Jan. 4, 2016

(87) PCT Pub. No.: WO2015/000023
PCT Pub. Date: Jan. 8, 2015

(65) Prior Publication Data

US 2016/0160631 A1 Jun. 9, 2016

(30) Foreign Application Priority Data

Jul. 5, 2013 (WO) ..... PCT/AU2013/000733

(51) Int. Cl.
*E21B 7/10* (2006.01)
*E21B 47/01* (2012.01)
(Continued)

(52) U.S. Cl.
CPC ..... *E21B 47/024* (2013.01); *E21B 7/00* (2013.01); *E21B 7/025* (2013.01); *E21B 25/02* (2013.01)

(58) Field of Classification Search
CPC ..... E21B 7/10; E21B 47/0001; E21B 47/01; E21B 47/123; E21B 47/024; E21B 7/025
See application file for complete search history.

(56) References Cited

U.S. PATENT DOCUMENTS 4,506,745 A 3/1985 Bjor ..... 175/45
5,361,854 A * 11/1994 Tull ..... E21B 47/022 175/45

(Continued)

FOREIGN PATENT DOCUMENTS

WO WO 2010/094054 A1 8/2010

OTHER PUBLICATIONS

International Search Report dated Nov. 13, 2014, issued to International Application No. PCT/AU2014/000697.

*Primary Examiner* — Cathleen R Hutchins
(74) *Attorney, Agent, or Firm* — Stein IP, LLC

(57) ABSTRACT

A laser alignment device for a drill rig having an elongate drill rod, the laser alignment device including a head unit having at least a pair of laser emitting devices mounted independently to one another thereon, each of the laser devices movable in one plane only and oriented in substantially opposite directions to one another, an attachment means to attach the head unit to a drill rig and a length adjustable assembly to adjust the separation distance between the head unit and the drill rod, wherein the alignment device is used to align at least the azimuth of the drill rod relative to survey marks.

21 Claims, 12 Drawing Sheets

(51) Int. Cl.

| | |
|---|---|
| ***E21B 47/024*** | (2006.01) |
| ***E21B 7/02*** | (2006.01) |
| ***E21B 7/00*** | (2006.01) |
| ***E21B 25/02*** | (2006.01) |

(56) References Cited

U.S. PATENT DOCUMENTS

| | | | | |
|---|---|---|---|---|
| 6,315,062 | B1 * | 11/2001 | Alft | E21B 7/046 166/255.2 |
| 6,342,946 | B1 * | 1/2002 | Holstein | G01B 11/27 33/286 |
| 7,845,432 | B2 * | 12/2010 | Salins | E21B 7/046 175/215 |
| 2007/0188742 | A1 | 8/2007 | Gunsaulis | 356/138 |

* cited by examiner

ALIGNMENT SYSTEM FOR ALIGNMENT OF A DRILL ROD DURING DRILLING

CROSS-REFERENCE TO RELATED APPLICATIONS

This application is a national stage of International Application No. PCT/AU2014/000697, filed Jul. 4, 2014, which claims the benefit of priority of International Application No. PCT/AU2013/000733, filed Jul. 5, 2013, in the World Intellectual Property Office, the disclosures of which are incorporated herein by reference.

TECHNICAL FIELD

The present invention relates to alignment devices and particularly to those which can be used to align drilling rigs to ensure correct drilling azimuth and/or dip angle whilst the drill rod is in the hole.

BACKGROUND ART

In mining, whether underground or surface mining (e.g. diamond mining, goldmining etc), once the mine has been formed, exploratory drill holes are typically then formed to try to locate ore bodies. These drill holes can have a length of up to 1 km bur are usually much shorter.

Initially, geologists will determine the likely location of an ore body or seam. The mine geologist will design the mine and the location of the exploratory holes and the surveyors will place survey markers in appropriate locations marking the intended hole positions. The survey markers will comprise a first mark on one wall of the mine and a second mark on an opposed wall of the mine. The markers are usually small reflective squares pinned to the mine wall. A "string line" between the two markers will show exactly the direction that the drilling apparatus will need to drill. This is known technology. For surface mines, a pair of pegs or markers inserted into the ground are typically used.

The direction typically includes the two components "elevation" and the "azimuth". The elevation is the angle to the horizontal at which the drill rod is oriented and the azimuth is the degree or direction about a vertical axis that the drill rod is oriented.

Ensuring the correct "elevation" is usually not a great problem as the drill rig can quite easily be angled upwardly or downwardly to the correct elevation. However, ensuring the correct "azimuth" has been a problem to date and even a small error in the azimuth can cause rejection of the bore hole.

Once the survey markers have been completed, a drill rig is positioned to drill the required core samples. The drill rig is usually a very large self-propelled apparatus. A typical apparatus comprises a wheeled or tractor vehicle which has a forwardly extending boom arm and attached to the boom arm is a drill rig. The drill rig is attached to the boom arm such that it can adopt any required angle (in FIG. 1 the drill rig is pointing downwardly).

This type of apparatus is well-known and there are many different sizes and types of such apparatus, such as that illustrated in FIG. 3 for example which is an example of a skid-steered self-propelled rig.

Once the drill rig is roughly in position (determined by the survey markers), it needs to be very accurately adjusted to the survey markers. Once the adjustment is complete, the drill rig is secured in position and this is usually done by bolting the drill rig to the mine floor using a known type of feed frame positioner. For larger rigs, the weight of the rig can be sufficient to maintain the position.

The drill rig is then turned on to drill the required hole.

The present invention is directed to a laser unit device that can be used to very accurately correctly adjust the azimuth of the rig prior to bolting (securing) the rig into position. Preferably, the laser unit device is a gyroscopically aligned laser unit device.

Conventionally, string lines are used to align the rig prior to securement of the rig into position. That is, a string line is stretched between the survey markers on the opposed walls of the mine shaft. The apparatus is then positioned as close as possible to the string line and is aligned with the string line (that is the drill rig is aligned to be parallel with the string line to get the correct azimuth). Because of the size and shape of the apparatus, it is not possible to place the apparatus against the string line and usually the apparatus will be some distance away from the string line. For a "normal" sized apparatus, the apparatus will still be about 1 m away from the string line but for a larger apparatus, this can be between 3 to 4 m from the string line. A measuring tape is then used to accurately measure the distance between the front and the rear of the apparatus and the string line to ensure that the apparatus is exactly parallel with the string line such that when a hole is drilled, the hole will be at the correct azimuth.

In practice, it is difficult to obtain the level of accuracy that is demanded by the geologists using this known technique of string lines and measuring tapes. Once a pilot hole is collared, and it reaches its first survey mark (normally at approximately 5 to 15 meters) a survey tool is then inserted into the drilled hole. This survey tool normally provides a reading of both the elevation and the azimuth of the pilot hole. The driller then checks this against the hole plans and if not exactly correct, the hole will need to be redone.

The cost of drilling each hole can be many thousands of dollars and it is not unknown for the cost to be about $100,000 per hole. A drilling contractor is not paid for a "rejected" hole.

There is also a significant secondary issue once the rig has been properly aligned prior to drilling and that is maintaining the drill rod in the correct orientation and direction whilst drilling is taking place.

In the present specification, the term "drill rig" is not intended to be limiting and includes any type of drill or surface rig adapted to drill a hole in any type of mine including a surface or underground mine.

It will be clearly understood that, if a prior art publication is referred to herein, this reference does not constitute an admission that the publication forms part of the common general knowledge in the art in Australia or in any other country.

SUMMARY OF INVENTION

The present invention is directed to a laser alignment device, which may at least partially overcome at least one of the abovementioned disadvantages or provide the consumer with a useful or commercial choice.

With the foregoing in view, the present invention in one broad form, resides in an alignment system for alignment of a drill rod during drilling of the hole including a laser device mounted relative to a drill rig to issue at least one laser emission and at least one detector device to detect at least one laser emission whereby the laser emission is used to determine the position of the drill rod in relation to the centre of the partially drilled hole whilst the drill rod is in the partially drilled hole.

According to a preferred embodiment, the system for alignment of the drill rod will typically include more than one component. Preferably, there will be at least a down hole component and a surface component provided in relation to the drill rig at the head of the hole being drilled.

Normally, the at least one laser device is provided in or as a part of the down hole component. The at least one detector device may also be provided in or as a part of the down hole component. The surface component is typically a reporting component in order to advise an operator of the alignment or misalignment of the drill rod.

The alignment system of the present invention includes at least one laser device mounted relative to a drill rig to issue at least one laser emission. More than one laser device can be provided depending upon the configuration and operation of the particular alignment system.

Further, any one or more of the laser devices provided can be directed in any direction. Typically, the particular configuration of the alignment system has a large bearing on the number and orientation of the laser devices provided.

The at least one laser device of the present invention may emit a steady beam or a pulse or a combination. Depending upon the use to which the laser device is put, the type of emission from the at least one laser device can be configured appropriately. The emission from the at least one laser device can be focused or dispersed to any degree.

The at least one laser device is typically mounted relative to a drill rig and more preferably, relative to the drill rod being used to drill the hole. According to the most preferred form, the drill rod provided is typically hollow or at least partially hollow and of the at least one laser device is provided as a part of the down hole component of the system of the present invention, within a hollow portion of the drill rod.

The at least one laser device and/or the down hole component of the system may be provided within a guide tube or similar arrangement which is received, preferably removably, within the hollow portion of the drill rod.

Alternatively, the at least one laser device may be provided within or relative to a housing portion which is attachable in-line over the length of the drill rod. Typically, the elongate drill rod used is formed from a series of portions attached to or relative to one another in order to form the drill rod. The housing portion preferably mimics the external dimension of an elongate drill rod and has attachment portions at either end allowing the attachment of the housing portion to a leading drill rod portion and if necessary following drill rod portion in order to provide a housing portion which is basically a part of the drill rod.

The at least one laser device may be removable from within the drill rod, guide tube or housing portion. Alternatively, the at least one laser device may remain in place, particularly while the drill rod is in use.

Typically, the at least one laser device is provided in or relative to a portion of the drill rod behind the drill head and preferably, is located closer to the drill head.

The least one laser device can be used in a number of different ways in order to assist with alignment of the drill rod during use. For example, the at least one laser device can be used to indicate an orientation or position of the drill rod and/onto convey information from one or more sensors or measurement devices to be surface component of the system of the present invention.

In one embodiment, the at least one laser device can be directed forwardly, namely in the direction of the drill rod cutting head. In this configuration, the drill rod is normally used to indicate the orientation position of the drill rod or to provide a measure of difference from the intended path or centre of the proposed drill hole.

At least one laser device may be provided directed rearwardly toward the drill rig.

Still further, at least one laser device may be provided directed laterally or radially, whether radially inwardly or radially outwardly.

Combinations of laser devices can be provided which are directed in more than one direction, for example, both forwardly and then radially or rearwardly and radially, or forwardly and rearwardly or both laterally or radially inwardly and outwardly. A single laser device may be provided which is directed in any one or more directions.

The at least one laser device can be used to give an indication of or to measure the distance to another object or component. For example, a laser device can be used to measure the distance between that the pipe and a wall of the hole being drilled or internally, to the centre of the rod or another portion of the rod. Normally, an appropriate calibration will be made such that the measurement made during the drilling of the hole can be used to then give an indication of the alignment of the drill rod when drilling, and/or an indication or measurement of any difference between the alignment in use and the desired alignment of the drill rod.

In a particularly preferred embodiment, particularly if it least one laser device is directed radially outwardly relative to the drill rod, it is preferred that the housing portion provided has one or more openings therein in order to allow the at least one emission to exit the drill rod and preferably, for a return emission to enter the housing portion to be detected by at least one detector.

The alignment system of the present invention also includes at least one detector in order to detect at least one emission issued by at least one laser device. The at least one detector can be any type of detector and for example, may be a static detector such as a plate or other device which may simply register the position at which the emission strikes the detector or alternatively, the detector may be a detector which is capable of receiving an emission or return emission and determining one or more aspects or parameters of the emission or in relation to the emission such as elapsed time from the issue of a primary emission to the receipt of a return emission.

The at least one detector may be fixed relative to the drill rig or preferably to the drill rod or alternatively, the at least one detector may be movable. According to a particularly preferred embodiment, the at least one detector may be movable within the drill rod along a longitudinal length of the drill rod. The movement of the at least one detector within the drill rod may be movement forced or driven by a sample which is typically dirt or rock which is received within the drill rod as a result of the drilling.

The preferred surface component of the alignment system of the present invention will typically be provided in association with the drill rig at the head of the hole being drilled. Typically, the at least one detector or other sensor device provided in or as a part of the down hole component, will collect information and then send this information to the surface component in order to allow the information or information calculated from that collected by the detector or sensor, to be viewed or displayed to the operator. Preferably, the surface component of the system may be provided with one or more communications pathways to allow information to be transmitted from the surface component to a remote display or other device. Typically, the operator in charge of the drill rig will not be located on the drill rig and will typically remain away from the drill rig for safety purposes. Information will typically be transmitted to a device which can be earned by the operator and according to which, the operator can monitor the information gathered by the alignment system of the present invention.

According to one preferred embodiment, the alignment system of the present invention will also provide information which allows the drill hole to be profiled as the down hole component moves downwardly within the hole or alternatively, as the down hole component is drawn out of the hole or both. In this way, the alignment system of the present invention and particularly, the at least one laser device provided as a part of the alignment system can be used for a dual purpose of aligning the drill rod or measuring any misalignment of the drill rod and also be used to create a profile model of the drill hole which may aid operators. Typically, a three-dimensional profile model can be created using the elements of the alignment system provided according to the present invention and typically using the information provided together with appropriate 3-D modelling software.

Additionally, at least one laser device provided as a part of the alignment system of the present invention may be used to properly aligned or aid in the alignment of the drill rod portions during attachment and detachment of the drill Rod portions relative to one another during drilling.

Therefore, as an alternative aspect, the present invention may reside in a drill rod alignment detector system including a laser device mounted relative to a drill rig for indicating a drill rod orientation and an alignment detector device adapted to be placed at least partially in a partially drilled hole and having a laser point detection portion that detects where a laser light point of the laser device strikes the face of the detector enabling calculation of the position of the drill rod in relation to the centre of the partially drilled hole.

Normally, the alignment tool discussed above is used during the original rig setup and the alignment tool is then removed from the drill rig. According to this aspect of the present invention, normally, after the hole is drilled to a sufficient indicated depth, the alignment tool can be reattached to the drill rig. Normally, no changes are made to the rig setup during this process, that is the alignment is not adjusted. The alignment detector attachment is then typically placed into the hole which has been partially drilled and the alignment tool or laser is directed at the alignment detector attachment.

The alignment detector attachment will preferably provide data to a display device outside the hole of the orientation of the laser and thereby of the drill rod in order to allow adjustment of the alignment tool and thereby adjustment of the drill rod to ensure correct drilling.

This alignment detector attachment preferably includes a laser point detection plate (typically an optical detection array) that detects where the laser light point strikes the face of the detector and will calculate this position in relation to the centre of the drilled hole, normally in two axes.

The orientation of the laser point detection plate in relation to the orientation of the alignment tool is preferably measured by rotational alignment detectors, which may be inclinometers measuring one or two axes or other similar inclination measuring device.

The alignment detector attachment is typically centred in the drilled hole by a mechanical centring mechanism. This will usually be a length of machined rod—similar to a drill rod and either of the same diameter as the drill rod used to drill the hole, or extended to this diameter using collars, extensions, bushes or similar devices.

This information or sufficient data to allow a visual representation of the orientation of the laser is preferably transmitted to a display device outside the hole. Transmission of this information may be by wireless communication means or by way of a hard wired connection. The information is then processed in software running on the display device to compensate for any rotation of the alignment tool within the hole. An image is preferably generated and displayed on the display in an easy to read information display depicting the angular offset of the hole from the centre line of the drill in two axes.

The alignment detector attachment will preferably be self centering in the hole and also be capable of self centering in a hole of any larger size. The alignment detector attachment will preferably have a detector allowing for positional and/or rotational alignment relative to the alignment tool or to determine alignment relative to the alignment tool.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

DESCRIPTION OF EMBODIMENTS

According to a preferred embodiment, a laser device for use with a drilling rig and a drill rig with the device attached, are provided.

Figure 1:
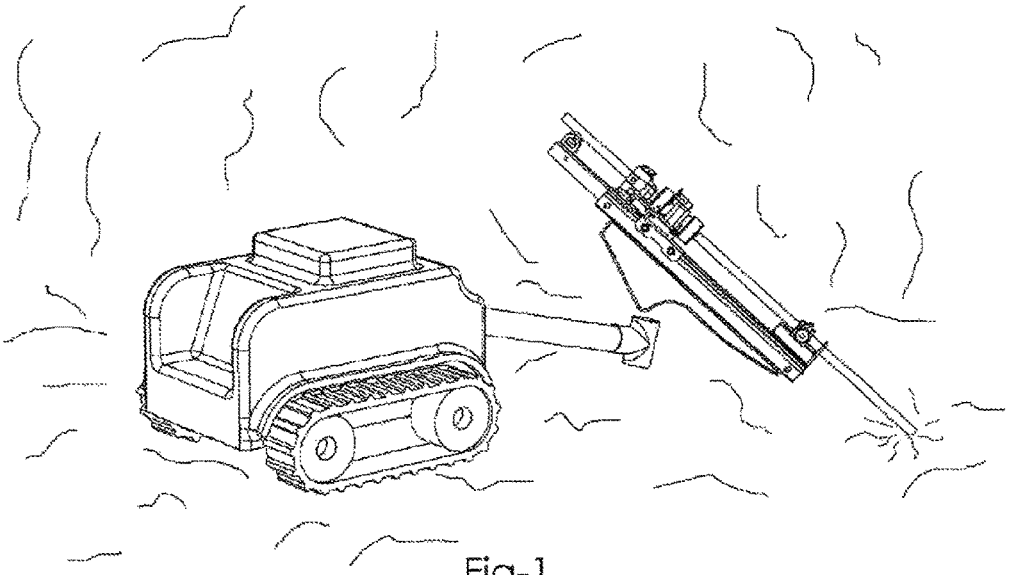
Fig-1 (Prior Art)
FIG. 1 is a perspective photograph of a conventional boom operated drill rig in operation.
Figure 2:
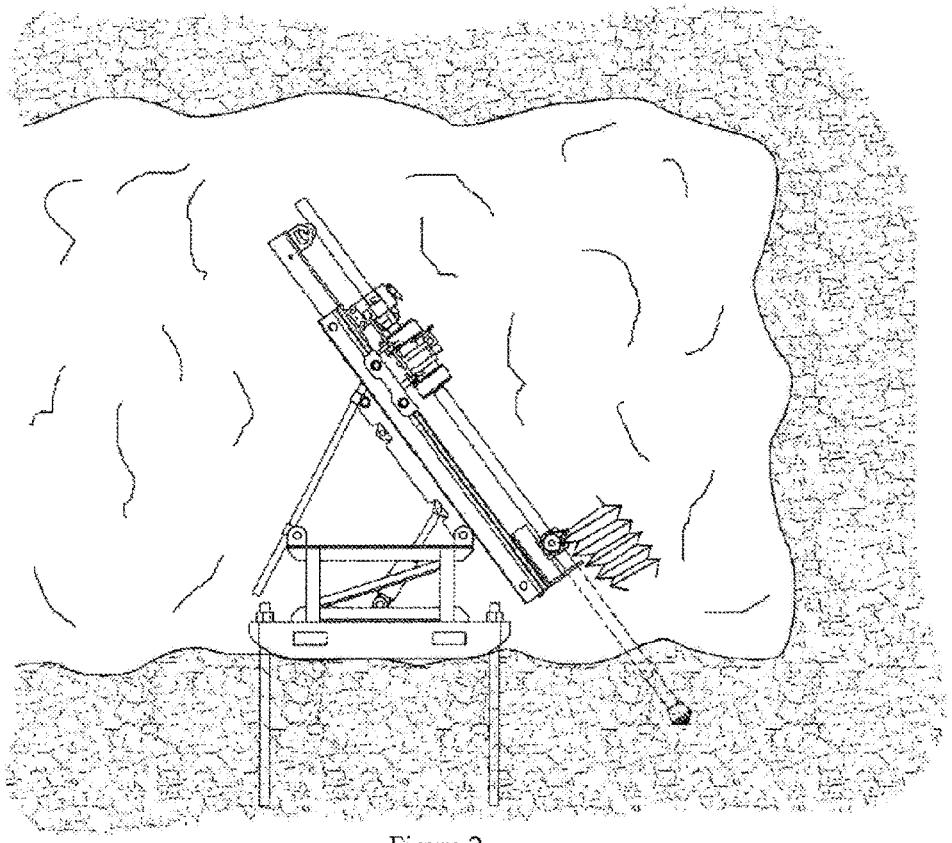
FIG. 2 is a side elevation view of a conventional skid-based drill rig in the installed configuration and anchored to the floor.

A conventional drill rig is illustrated in FIG. 2. The drilling rig itself is of a commercial type and basically comprises a pair of parallel steel feed rails which will typically have a length of between 1.5 m up to 6 m. A carriage 1 slides over the top of each feed rail, and can reciprocate between the retracted position illustrated above and an extended position where the carriage has been moved to the front of the feed rails 10. A hydraulic ram powers the carriage between its positions. On top of the carriage is a high speed hydraulic rotating apparatus. The rotating apparatus will typically rotate at speeds of between 1000-10,000 rpm. A drill rod (not illustrated) passes into the front opening of the rotating apparatus and is rotated by the rotating apparatus. In a front part of the drill rig is a "centraliser" through which the rods pass and the function of the centraliser is to keep the rods aligned and to minimise "wobble". A hydraulic piston is associated with the centraliser. The piston extends to lock the drill rod when the drill rod has stopped rotating.

FIGS. 3 to 13 show different preferred embodiments of alignment systems for alignment of a drill rod during drilling of the hole. All of the embodiments illustrated including at least one laser device mounted relative to a drill rig to issue at least one laser emission and at least one detector device to detect at least one laser emission whereby the at least one laser emission is used to determine the position of the drill rod in relation to the centre of the partially drilled hole whilst the drill rod is in the partially drilled hole.

Figure 3:
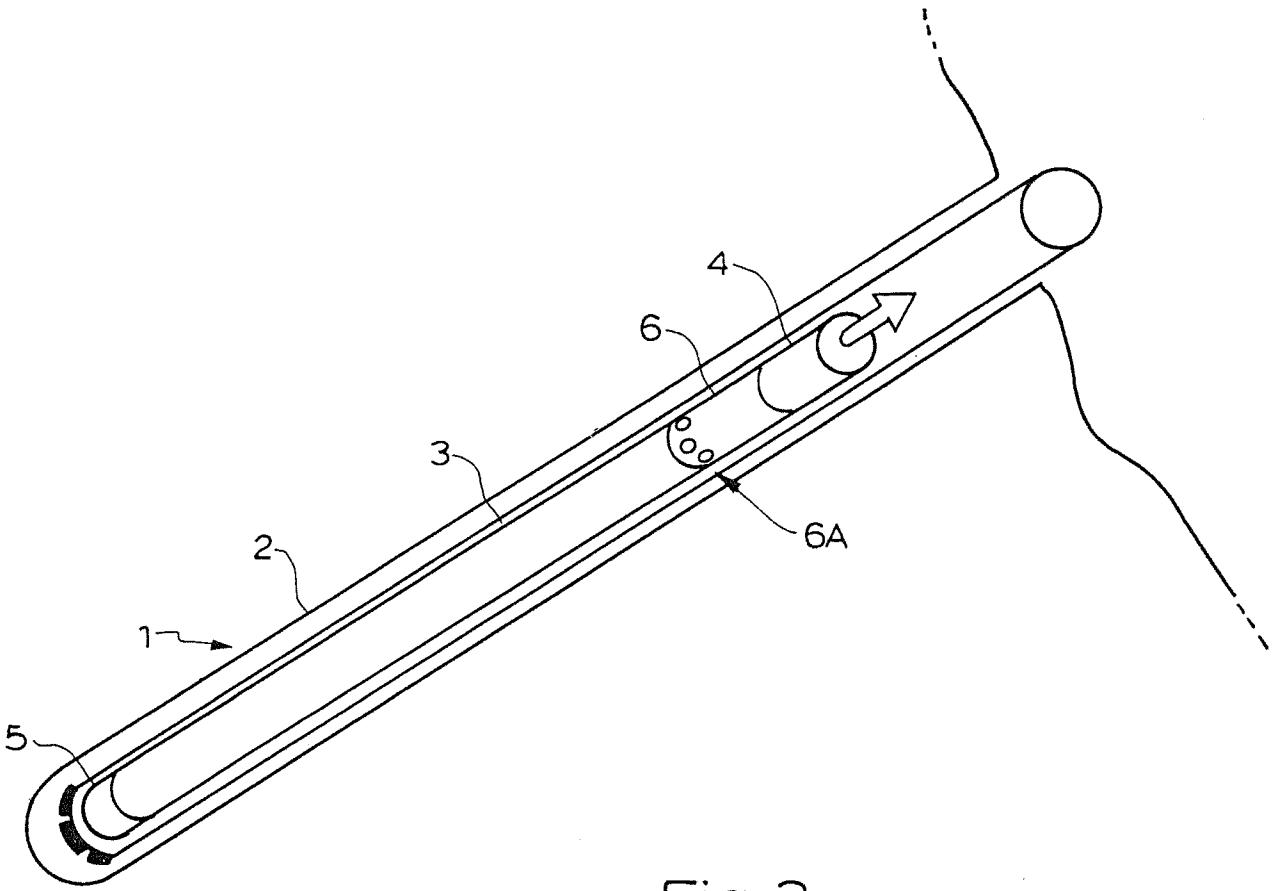
FIG. 3 is a schematic side elevation view of a drill rod with a downhole drill alignment component according to a preferred embodiment of the present invention provided in a guide tube.

FIG. 3 shows the simplest configurations of the present invention. As illustrated in FIG. 3, a drill rod 5 is provided to drill a hole 1. As the drill rod 5 extends downwardly, it removes material to form a substantially cylindrical wall 2. As illustrated in FIG. 3, the drill rod 5 is provided with an inner guide tube 3. A forward end of the inner guide tube 6 is provided adjacent to the drill head at the left-hand end of the figure. A downhole component of the alignment system of the present invention and is provided as a combined inertial device 4 and a housing 6 which includes at least one laser device adapted to issue an emission laterally through the openings 6 A in the housing 6. In this aspect, the downhole component of the alignment system of the present invention can be moved relative to the cutting head of the drill rod 5 as the hole is drilled through the inner guide tube 3. As this occurs, the laser emission and associated detector within the downhole component can be used to profile the inside of the drill hole by measuring the separation distance between that the different sides of the housing 6 and the wall 2 of the drill hole. The inertial device 4 can provide additional information such as pitch, roll and heading.

Figure 4:
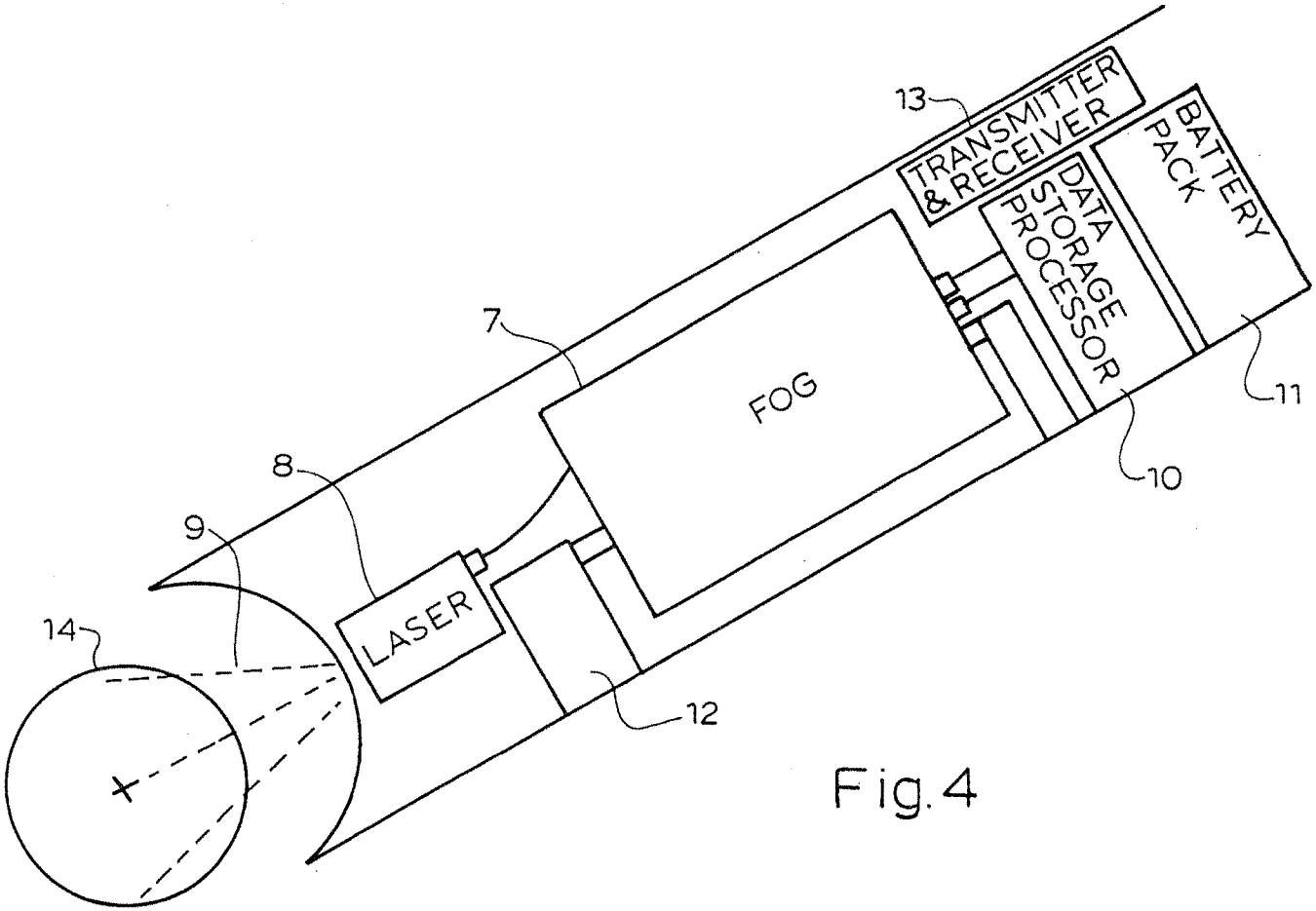
FIG. 4 is a detailed sectional view of the down hole drilled alignment component of the configurations illustrated in FIG. 3.

FIG. 4 is a more detailed schematic view of the inner workings of a downhole alignment component. In this particular embodiment, the downhole component includes a fibre optic gyro (Inertial device) which is mounted using an appropriate bracket mount 12. The inertial device can be mounted in any way including a gimbal setup or bracket 12, and the actual mounting method used is typically dependent upon the type of inertial device. The downhole component illustrated in FIG. 4 also includes a forwardly oriented laser device 8. According to this particular embodiment, the laser emits a dispersed beam 9 forwardly. A position sensitive device (PSD) 14 is provided in front of the dispersed beam 9 in order to calculate the position/orientation of the laser device.

The down hole alignment component also includes a data processor with storage 10 and a battery pack 11 to provide power to the inertial device and the laser. Also provided in the downhole component is a transmitter and receiver in order to send and receive information and instructions from the downhole component to a surface component to process the information. Once the surface component of the system has received the information, information can then be either further processed by the surface component or transmitted, typically via a wireless transmission method such as Bluetooth or by hardwire to a computer processor, typically a tablet. One particularly preferred form of transmitter and receiver for use with the downhole component is one adapted for laser pulse communication such that laser pulses can be transmitted downwardly to the downhole component through the drill pipe (within which the downhole component is typically housed). The system of the present invention may include repeaters or signal boosters to aid with the transmission of the signal between the downhole component in the surface component.

There is provision in some drill rods to include a component known as a core lifter used to retrieve a sample from a formation. The retrieved sample may then be evaluated to determine its contents.

The drill string typically includes an open-faced drill bit, an outer tube of a core barrel assembly, and a series of connected drill rods, which may be assembled section-by-section as the drill bit and the core barrel assembly move deeper into the formation. The outer tube of the core barrel assembly may be connected to the drill bit and the series of drill rods. The core barrel assembly may also include an inner tube assembly, which may be releasably locked to the outer tube. With the inner tube assembly locked to the outer tube, the drill bit, the core barrel assembly and the drill rods may be rotated and/or pushed into the formation to allow a core sample to be collected within the inner tube assembly. After the core sample is collected, the inner tube assembly may be unlocked from the outer tube. The inner tube assembly may then be retrieved using a retrieval system, while portions of the drill string remain within the borehole.

The core sample may be removed from the retrieved inner tube assembly, and after the core sample is removed, the inner tube assembly may be sent back and locked to the outer tube. With the inner tube assembly once again locked to the outer tube, the drill bit, the core barrel assembly and the drill rods may again be rotated and/or pushed further into the formation to allow another core sample to be collected within the inner tube assembly. Desirably, the inner tube assembly may be repeatedly retrieved and sent back in this manner to obtain several core samples, while portions of the drill string remain within the borehole. This may advantageously reduce the time necessary to obtain core samples because the drill string need not be tripped out of the borehole for each core sample.

Figure 5:
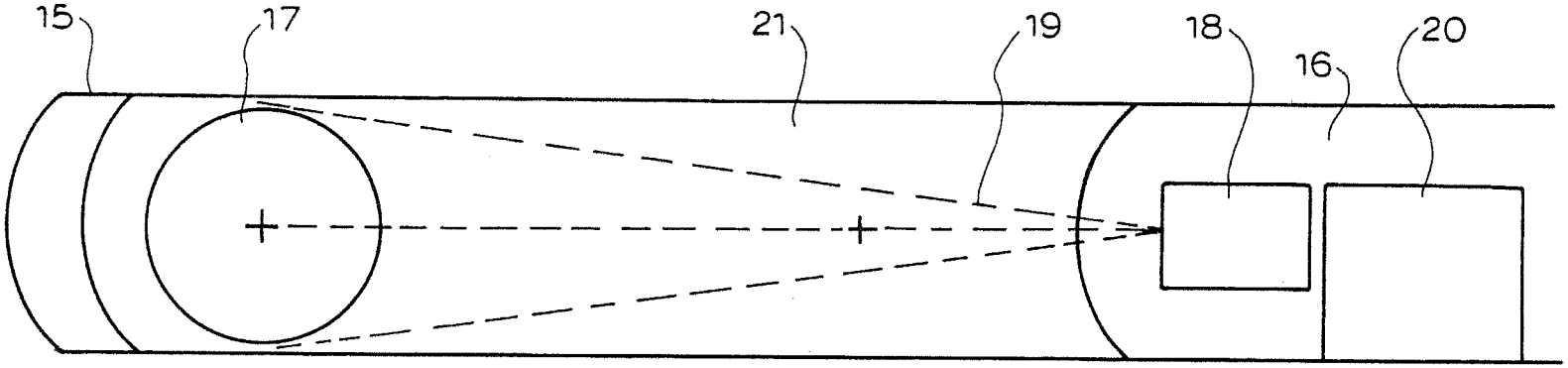
FIG. 5 is a schematic side elevation view of a downhole drill alignment component according to an alternative embodiment of the present invention.

The particular embodiment illustrated in FIG. 5 includes a PSD 17 or similar device placed inside the core lifter 15. When the core lifter is seated the housing 16 including the PSD 17 or similar device is inside core lifter case. A laser 18 is provided in a downhole component of the system of the present invention and the laser preferably emits a dispersed beam 19 inside the core lifter tube onto the PSD 17. The PSD 17 is normally separated from the laser over a distance of approximately 3 meters 21. The information gained from the relative positions of the PSD 17 and the dispersed beam 19 can be used to calculate the orientation of the drill rod. As drilling was undertaken, the core is forced upwardly within the core lifter tube, and the laser device can be used to profile the inside of the drill hole. Preferably, the PSD 17 moves up the core lifter tube and further information can be gained as to the orientation of the drill rod and the drill hole with the aid of an inertial device 20 for heading reference, pitch and roll information.

FIG. 5 also shows the PSD 17 moving up the tube finally ending up near the laser 18 which in turn creates a profile of the 3 meter run giving any deviation. This can also be done over the hole length of the pipe not just limited to the tube. The information gained can be downloaded into a separate or remote tool or tablet when the tube is brought to the surface or this can be done over the entire length of drill hole or pipe if there is no tube as alternative. Alternatively, this can be done each run, either way (as the tube goes down into the hole and/or as it is retrieved from the hole) and can be used to build a profile of the drill hole in relation to the initial setup orientation. The information can be constantly updated if there is no tube. As there are many types of drilling, some require tubes and some don't. Some have the core sample [dirt/rock and the like] come up inside of rods and some between hole wall and the drill rod.

Figure 6A:
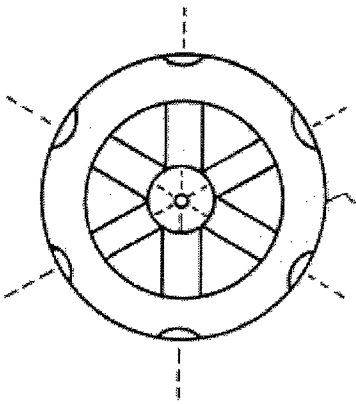
FIG. 6A is a sectional view of a forward portion of the component illustrated in FIG. 6.
Figure 6:
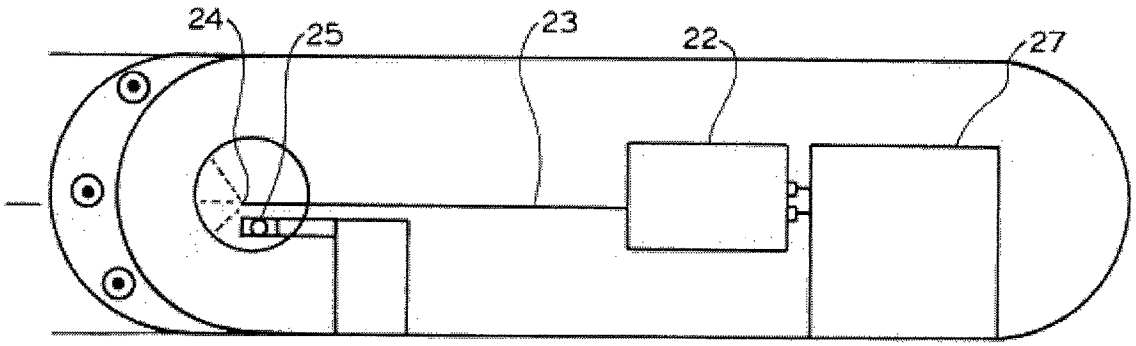
FIG. 6 is a schematic side elevation view of a downhole drill alignment component according to another alternative embodiment of the present invention.

FIGS. 6 and 6A show another aspect to the invention. In this particular embodiment, the downhole component includes a forwardly oriented laser device 22 which emits beam 23 into a beam splitter located at position 24. The beam splitter will typically include a reflective screen which splits the laser beam into multiple tubes. This is illustrated particularly in FIG. 6 A. The laser beams produce a return emission back from the exterior of the housing, typically from the hole wall and the return emission is recorded via a miniature CCTV and a distance measuring device 25. Again, when this information is considered with the information which can be gained from the inertial device 27, this allows the downhole component and the system of the present invention to profile the inside of the drill pipe or drill hole. The data can be sent up the drill pipe or held on board inappropriate data storage to allow the data to be downloaded when tube is out of the hole.

FIG. 6A shows a rear view of one possible configuration of beam splitter. As the beam reflects into the tubes, a component of the beam is allowed to continue forward in the direction of the drill head to collect information from that direction.

Figure 7:
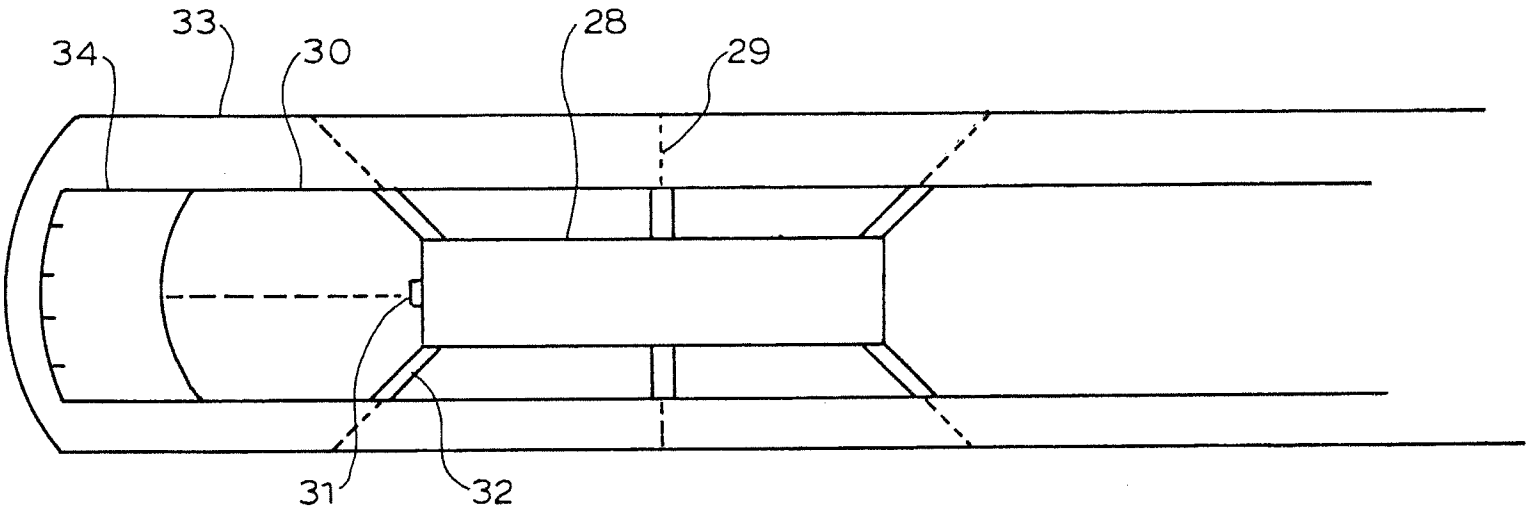
FIG. 7 is a sectional side view of yet another alternative embodiment of the downhole component according to a preferred embodiment of the present invention.

FIG. 7 shows another possible embodiment of the down hole component located inside a drill rod. This embodiment is likely to particularly fine application in the drill rod configurations in which the sample travels between the drill rod and the drill hole wall 33. As can be seen from FIG. 7, a series of laser beams 29 project outwardly from the downhole component which houses a laser device, onto the wall of the drill hole 33. The downhole component is located within the drill rod 30. The A forwardly directed laser 31 is provided pointing in the direction of drilling to collect information from that direction. According to the embodiment illustrated, the downhole component can be either gimbal mounted or bracketed permanently or semi permanently inside the drill rod using a series of arms 32 radiating from the downhole component which can also be used to direct the laser beams 29. The use of spaced apart arms allows air and water to still pass through to the drill bit 34.

Figure 8:
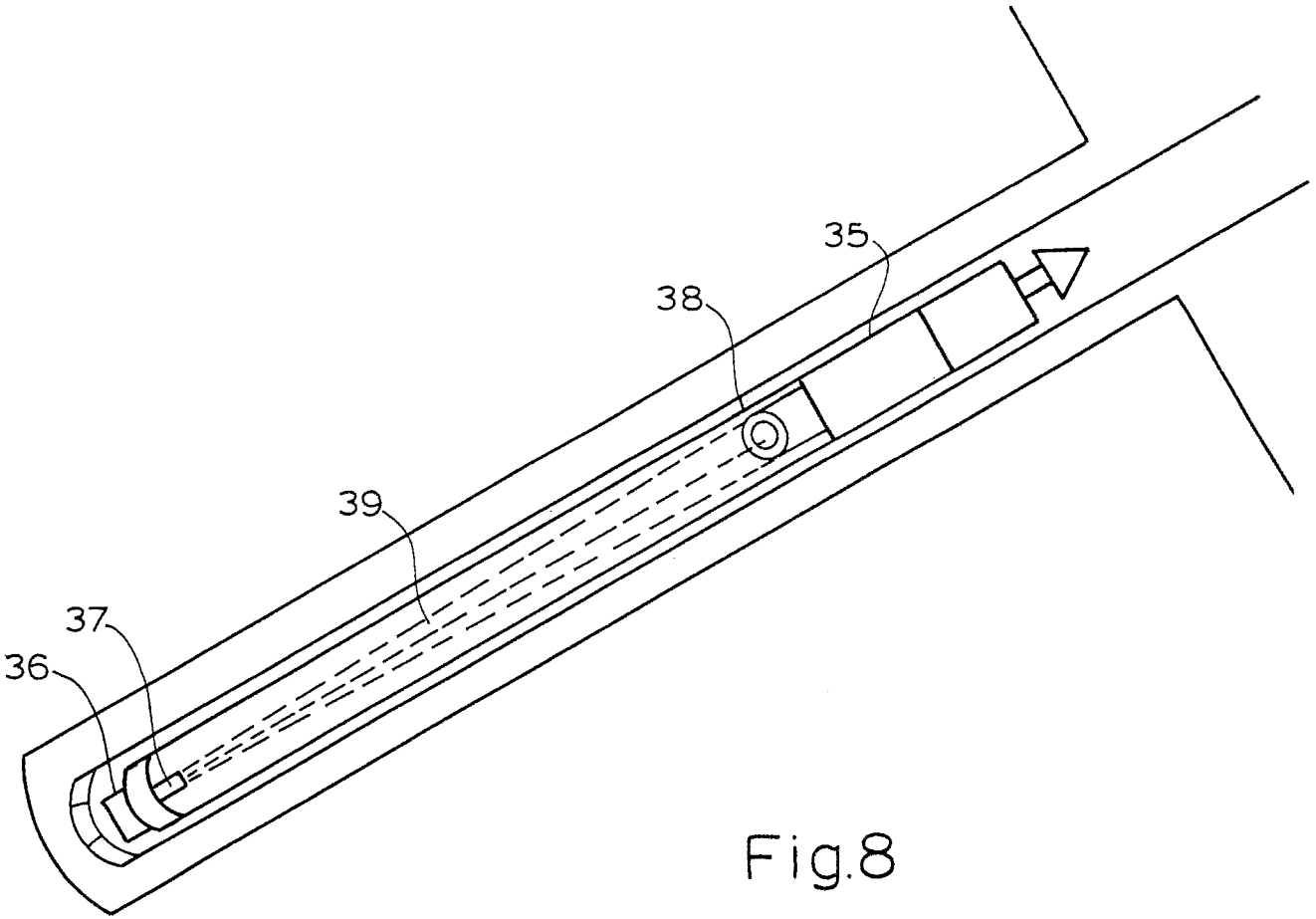
FIG. 8 is a sectional side view of still another alternative embodiment of the downhole component according to a preferred embodiment of the present invention.

FIG. 8 shows another aspect of the down hole components of the present invention. According to this embodiment, the downhole component is provided within a housing 35 which includes an inertial device. The at least one laser device of this configuration is provided within a central guide tube, but towards a forward end of the guide tube located within the elongate drill rod. An attaching assembly or mounting assembly 36 is provided at a forward end of the guide tube which mounts the laser 37 to direct the laser beam 39 from a forward end of the guide tube back towards the head of the hole. A PSD or similar device 39 is provided on a forward end of the housing 35. Again, the laser 37 is separated from the PSD 39 by distance of approximately 3 meters. This distance may change as the core sample pushes the laser to award of the housing 35 but over the distance, the information gained will show the deviation in the hole.

Figure 9:
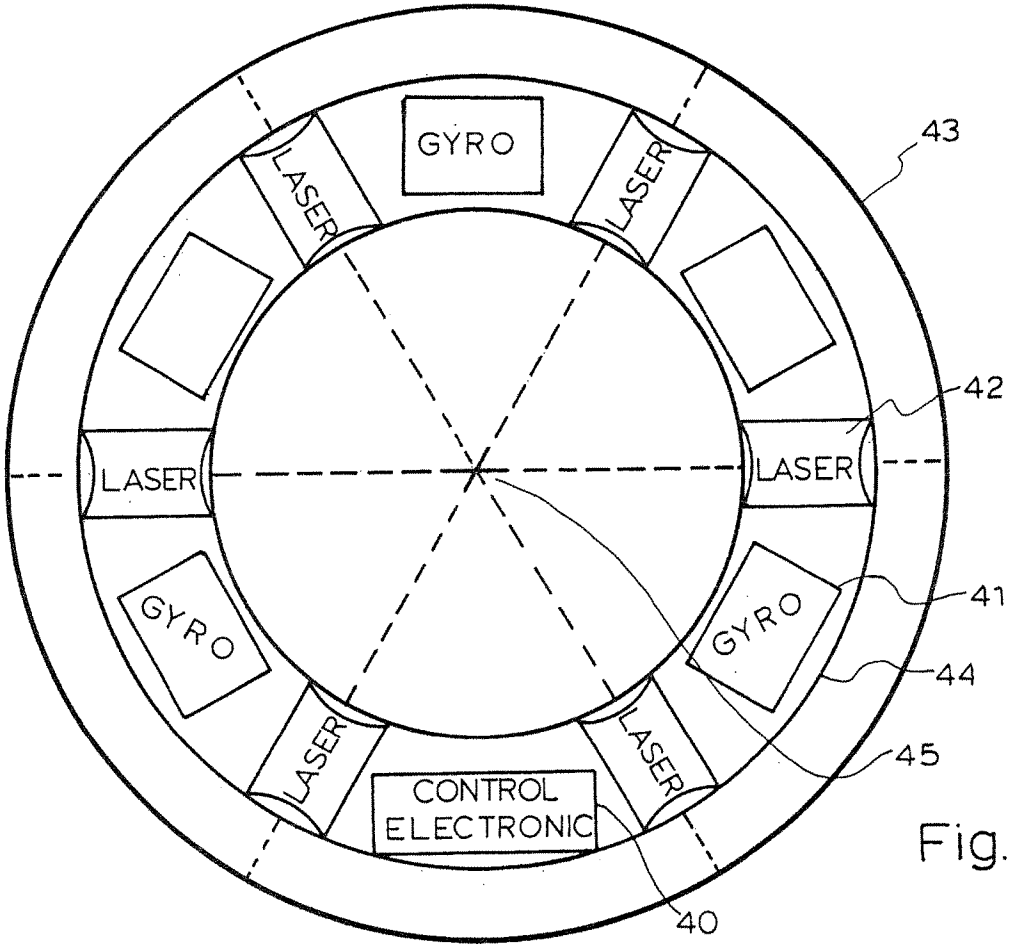
FIG. 9 is a sectional view of yet another alternative embodiment of the downhole component according to a preferred embodiment of the present invention.

FIG. 9 shows yet another aspect of the invention. In this particular embodiment, the laser devices 42 are still directed radially outwardly toward the wall 43 of the drill hole. In this particular embodiment, a number of laser devices 42 are provided spaced around the inside of the housing 44 located within the drill Rod. Control electronics 40 controls the operation of the laser devices and the inertial device is 41 which in this embodiment is a number of gyros. As illustrated in this embodiment, each of the laser devices 42 emits a beam which shines in two directions, namely, to the inside of the rod to create a centre point 45 and to the wall 43 of the hole. This can also be used for finding the centre of the sample and profiling the as it moves past the laser beams, as well as for ensuring that the drill rod is centred within the hole or foot measuring any deviation from the centre by providing at least one detector to measure the length of any one or more of the respective laser beams.

Figure 10:
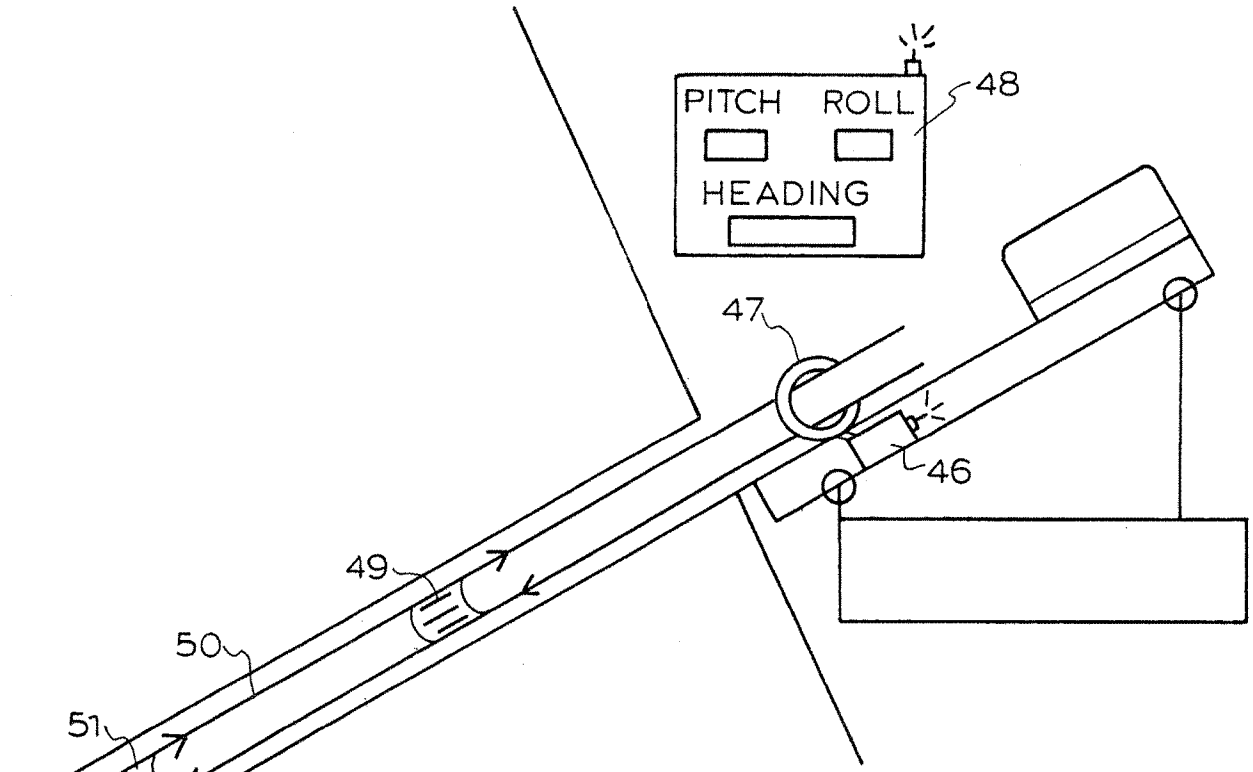
FIG. 10 is a schematic side elevation view of an alternative embodiment of the system of the present invention.

FIG. 10 illustrates a more complete view of the system according to a preferred aspect of invention. A laser inertial device 46 with transmitter and receiver is located at the surface, typically at attached to the drill rig. A clamp type device 47 is provided to either permanently clamp around the drill rod or to be removably located thereabouts to send and to receive information through a transmitter receiver collar 49 to aid with the transmission of a signal 50 to and from the downhole laser inertial device 51, which will typically be of a form similar to that illustrated in any one of FIGS. 3 to 9. The signal 50 typically travels through the drill rod, being sent and preferably received by the collar 47. The data returned is in turn processed by the surface component 46. Any data collected for calculations made by surface component 46 are preferably then communicated, typically via a wireless link such as Bluetooth to a remote tablet or PC which will display pitch, roll and/or heading to an operator. With the aid of the laser and the downhole inertial device 51, the system creates a three-dimensional profile model of the drill hole aiding operators and geologist by providing a full profile from when the hole was first started to the end of hole depth so that the rod orientation and a deviation can be calculated both at setup and then monitored over the course of the drilling whilst the rod remains in situ.

Figure 11:
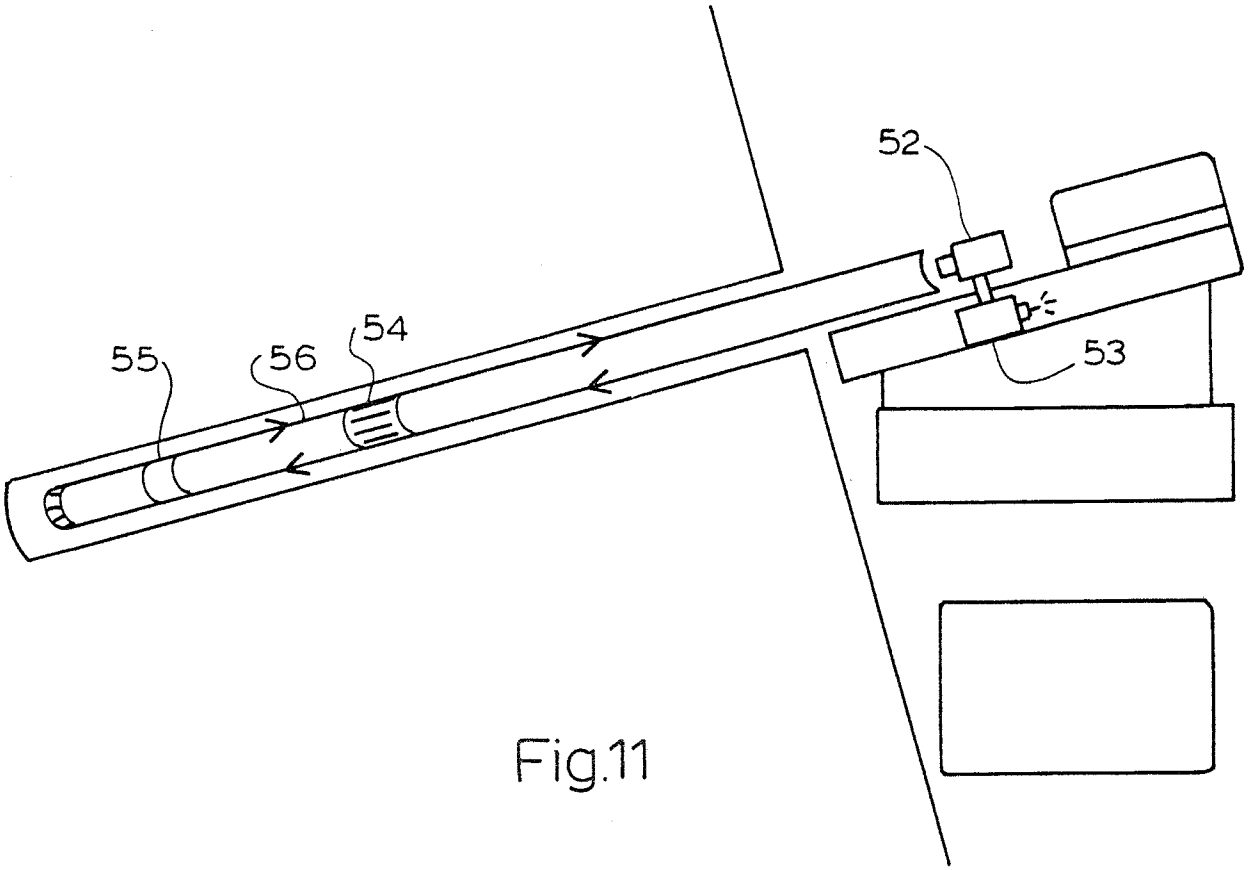
FIG. 11 is a schematic side elevation view of an alternative embodiment of the system of the present invention.

FIG. 11 shows a different aspect of the invention where the inertial system and data processor 53 is mounted to the side of the drill rig or anywhere on the drill rig. The laser device 52 is automatically positioned over the drill pipe or hole which is used to send laser pulse signals 56 through the booster collar 54 to the downhole laser inertial device 55 which includes a transmitter receiver 55. In this embodiment, the downhole device 55 can be provided as a backup up to laser device 52 and inertial device 53 aw the two devices can be used in concert to build up a more accurate picture of the orientation of the drill rod and/or to profile the hole.

This configuration can be reversed so that the beam travels back up the drill pipe or hole and the data gained then processed and transmit calculated data to remote PC or tablet.

Figure 12:
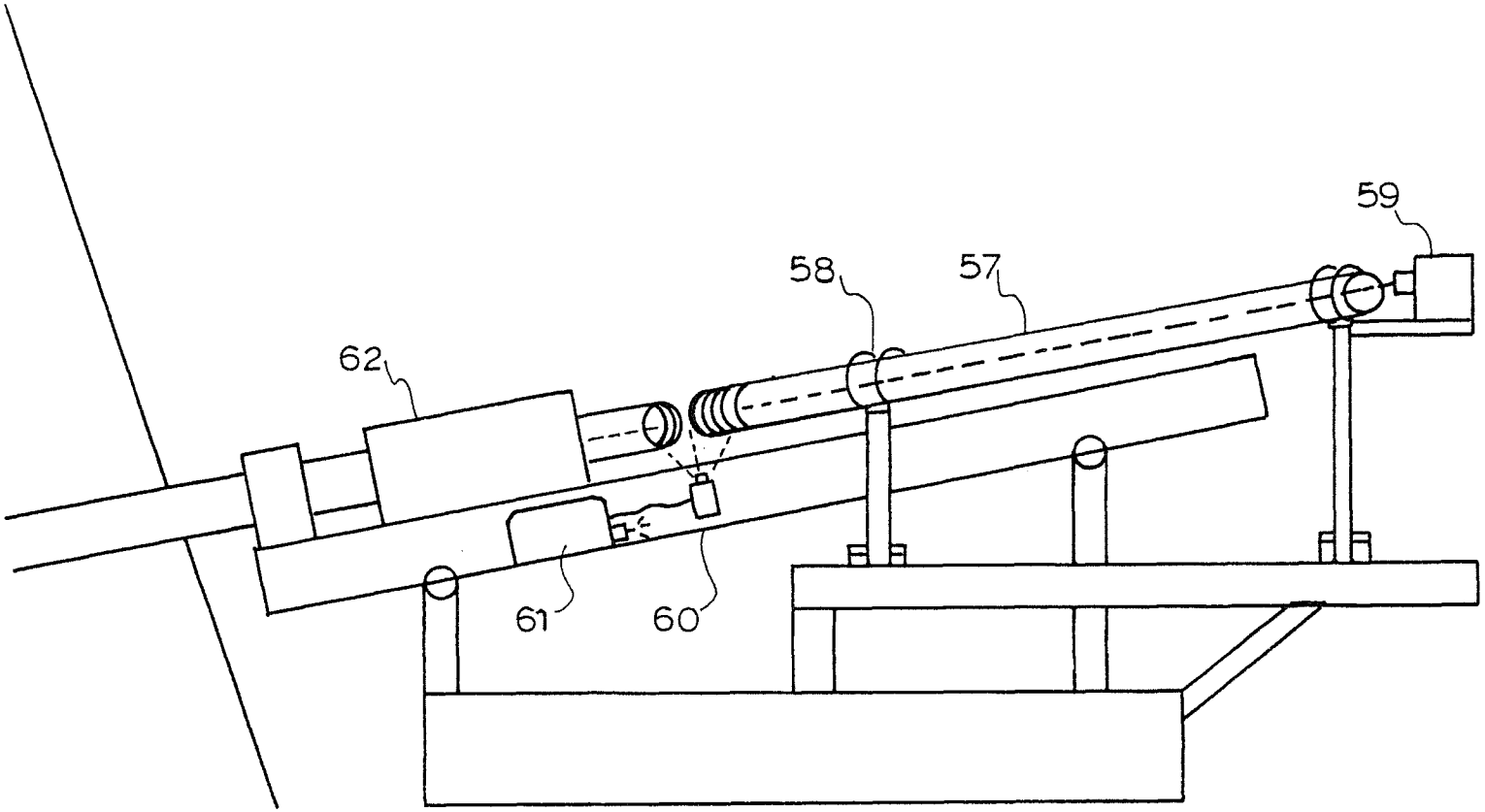
FIG. 12 is a schematic side elevation view of an alternative embodiment of the system of the present invention using a laser device to orient drill rod portions before attachment.

FIG. 12 shows another part of this invention, namely the use of the lasers and inertial devices to help accurately align the drill rod portions 57 when they are being automatically loaded by a rod handler device 58 onto the drill rig. This will assist the correct orientation of the drill rod so the threads can be accurately aligned preventing rods being cross threaded, under threaded and/or over tightened. It can also assist with the makeup and breaking of the threads in conjunction with the rod handler device 58. The Figure shows the drill rod portion 57 being aligned while it is on the automatic rod handler 58. The laser and inertial device 59 emits a beam through the centre of the rod portion 57 which can be detected by a detector slaved to the automatic rod handler 58. A beam can be provided in an alternative position such as along a portion of the drill rod or parallel thereto. An additional laser device may be provided at position 60 in order to aid with the thread alignment, make up and break up of threads by providing accurate and detailed information about the position of the respective rod ends as well is the separation distance and the distance from the beam directed through the centre of the Rod portion 57. A control electronic inertial device 61 is preferably provided in relation to the additional laser device at position 60. This system is provided on the drill rig 62 and all of this process can work in concert with the drill rig electronics and hydraulics so it can become a fully automatic system.

Figures 13, 13A, 13B:
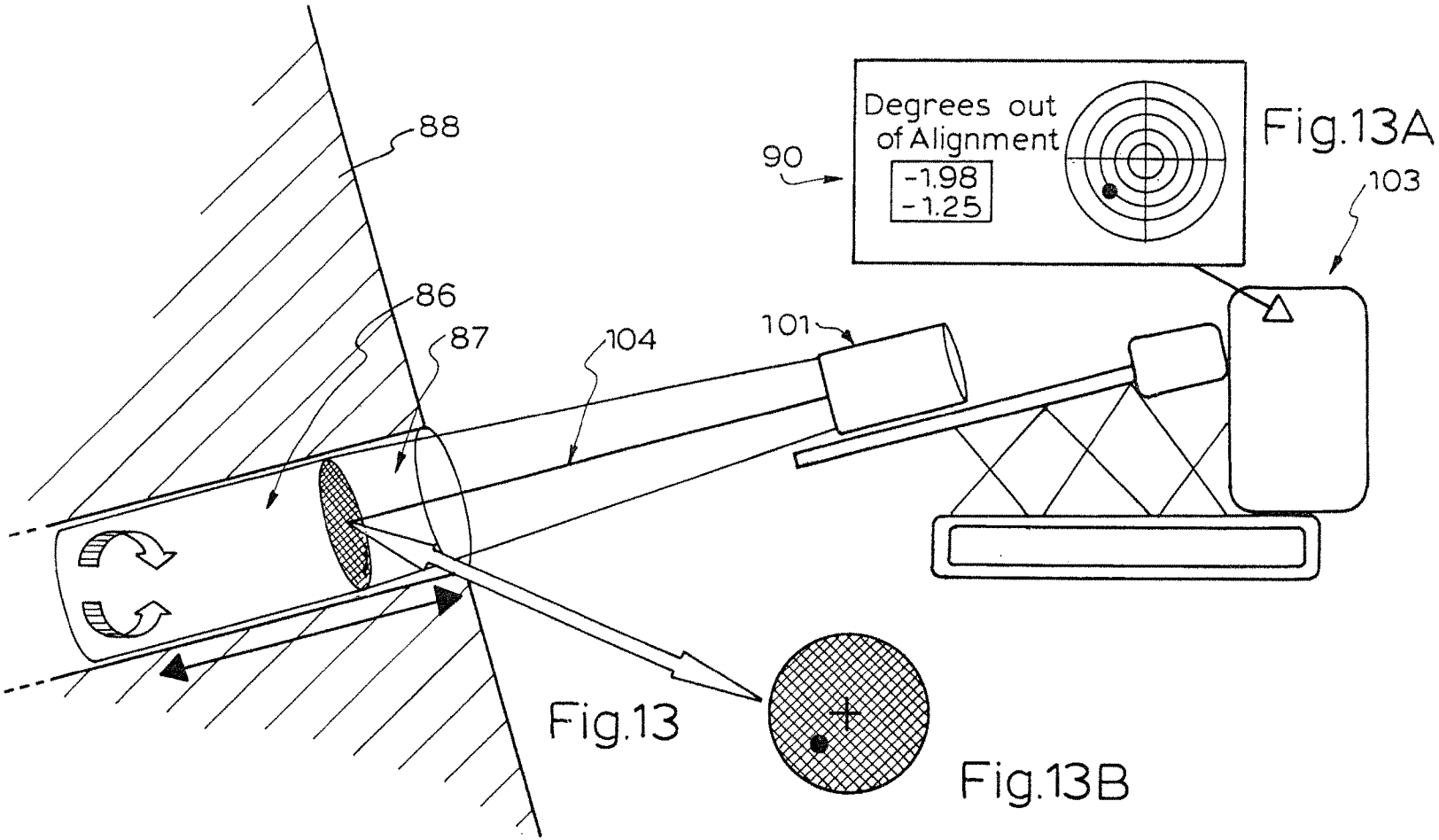
FIG. 13 is a schematic illustration of an alignment/orientation detector according to a preferred embodiment of the present invention.
FIG. 13A is a detailed view of the detector plate illustrated in FIG. 13 showing the laser point.
FIG. 13B is a detailed view of the detector plate illustrated in FIG. 13 showing the output display according to a preferred embodiment of the present invention.

Another alternative mechanism to allow the operator to ensure that the hole drilled remains on line, an alignment detector attachment and system can be provided such as is illustrated in FIG. 13. The alignment tool head unit 101 with laser device discussed above can be used with a laser alignment detector attachment as a part of a system to ensure that the hole 87 in the surface 88 remains online as it is drilled as well as at setup.

Normally, the alignment tool head unit 101 discussed above is used during the original rig setup and the alignment tool head unit 101 is then removed from the drill rig. According to the preferred embodiment illustrated in FIG. 13, normally, after the hole 87 is drilled to a sufficient depth (generally at least 300 mm and normally at any depth or depths following that), the alignment tool head unit 101 can be reattached to the drill rig. Normally, no changes are made to the rig setup during this process, that is the alignment is not adjusted. The alignment detector attachment 86 is then typically placed into the hole 87 which has been partially drilled and the laser is directed at the alignment detector attachment 86.

The invention claimed is:

1. An alignment system for alignment of a drill rod during drilling of a hole, the drill rod having an elongate axis, the system including:

i. at least one laser device mounted relative to a drill rig to issue at least one laser emission, wherein the laser device is directed orthogonally relative to the elongate axis of the drill rod or radially relative to the elongate axis of the drill rod, and ii. at least one detector device to detect at least one laser emission, whereby the at least one laser emission is used to determine the position of the drill rod in relation to the centre of the partially drilled hole whilst the drill rod is in the partially drilled hole.

2. An alignment system as claimed in claim 1 including at least a down hole component and a surface component provided in relation to the hole being drilled.

3. An alignment system as claimed in claim 2 wherein the down hole component is provided within a guide tube received within a hollow portion of the drill rod.

4. An alignment system as claimed in claim 2 wherein the down hole component is provided within or relative to a housing portion which is attachable in-line over the length of the drill rod.

5. An alignment system as claimed in claim 2 wherein the at least one laser device is provided in or as a part of the down hole component.

6. An alignment system as claimed in claim 2 wherein the at least one detector device is provided in or as a part of the down hole component.

7. An alignment system as claimed in claim 2 wherein the surface component is in communication with a reporting or display component in order to advise an operator of the alignment or misalignment of the drill rod.

8. An alignment system as claimed in claim 1 wherein the at least one laser device emits a steady beam or a pulse or a combination of said beam and said pulse.

9. An alignment system as claimed in claim 1 wherein the at least one laser device is fixed in place while the drill rod is in use.

10. An alignment system as claimed in claim 1 wherein the least one laser device indicates an orientation or position of the drill rod.

11. An alignment system as claimed in claim 1 wherein the least one laser device emits the emission used as a carrier to transfer information within the system.

12. Art alignment system as claimed in claim 1 wherein the at least one laser device is directed forwardly in the direction of the drill rod.

13. An alignment system as claimed in claim 1 wherein the at least one laser device is directed rearwardly of the drill rod.

14. An alignment system as claimed in claim 1 wherein the at least one laser device is directed radially inwardly or radially outwardly.

15. An alignment system as claimed in claim 1 wherein the at least one laser device is directed is used to give an indication of or to measure the distance to another object or component.

16. An alignment system as claimed in claim 1 wherein the at least one laser device is provided within a housing portion including one or more openings therein in order to allow the at least one emission to exit the drill rod and for a return emission to enter the housing portion to be detected by at least said one detector device.

17. An alignment system as claimed in claim 1 wherein the at least one detector device is a statue detector to register a position at which the at least one emission strikes said detector device.

18. An alignment system as claimed in claim 1 wherein the at least one detector device receives a return emission and determining one or more aspects or parameters of the return emission or in relation to the emission including elapsed time from the issue of a primary emission to the receipt of the return emission.

19. An alignment system as claimed in claim 1 wherein the alignment system provides information allowing the drill hole to be profiled as a down hole component moves downwardly within the drill hole or as the down hole component is drawn out of the drill hole or both.

20. An alignment system as claimed in claim 1 further including an inertial measurement device to provide information as to orientation of the drill rod.

21. A drill rod alignment detector system including, i. at least one laser device mounted relative to a drill rig, the drill rig including a drill rod having an elongate axis, the at least one laser device to issue at least one laser emission for indicating an orientation of the drill rod, wherein the laser device is directed orthogonally relative to the elongate axis of the drill rod or radially relative to the elongate axis of the drill rod, and ii. an alignment detector device adapted to be placed at least partially in a partially drilled hole and having a laser point detection portion that detects where a laser light point of the laser device strikes the face of the detector enabling calculation of the position of the drill rod in relation to the centre of the partially drilled hole.

* * * * *